US008607540B2

(12) United States Patent
Betz et al.

(10) Patent No.: US 8,607,540 B2
(45) Date of Patent: Dec. 17, 2013

(54) ROVING MACHINE FOR PRODUCING A ROVING

(75) Inventors: Dorothee Betz, Pfullingen (DE); Simon Küppers, Stuttgart (DE)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 13/446,005

(22) Filed: Apr. 13, 2012

(65) Prior Publication Data

US 2012/0285134 A1 Nov. 15, 2012

(30) Foreign Application Priority Data

Apr. 13, 2011 (CH) ..... 0653/11

(51) Int. Cl.
*D01H 7/00* (2006.01)

(52) U.S. Cl.
USPC ..... 57/350

(58) Field of Classification Search
USPC ..... 57/315, 333, 350, 403; 19/65 A, 66 R, 19/150
See application file for complete search history.

(56) References Cited

U.S. PATENT DOCUMENTS

| | | | | |
|---|---|---|---|---|
| 5,263,310 | A * | 11/1993 | Mori | 57/328 |
| 6,209,304 | B1 * | 4/2001 | Feuerlohn et al. | 57/328 |
| 2004/0025488 | A1 * | 2/2004 | Anderegg et al. | 57/400 |
| 2008/0072562 | A1 * | 3/2008 | Wust et al. | 57/333 |
| 2009/0094958 | A1 * | 4/2009 | Weide et al. | 57/263 |
| 2012/0192541 | A1 * | 8/2012 | Artzt et al. | 57/350 |

FOREIGN PATENT DOCUMENTS

| | | |
|---|---|---|
| DE | 32 37 989 A1 | 7/1983 |
| EP | 0 375 242 | 6/1990 |

* cited by examiner

*Primary Examiner* — Shaun R Hurley
(74) *Attorney, Agent, or Firm* — Dority & Manning, P.A.

(57) ABSTRACT

A roving machine for producing a roving from a sliver has at least one spinning station that has a vortex chamber with an infeed opening for the sliver and a roving forming element in the form of a spindle extending at least partially into the vortex chamber. The vortex chamber is associated with at least one air nozzle via which air is guided into the vortex chamber, and wherein the spindle has a draw-off channel via which the roving is drawn out of the vortex chamber. In the region of the vortex chamber, the draw-off channel has an inlet port for the roving to be drawn out of the vortex chamber, wherein the inlet port has an inner diameter that lies between 4 mm and 12 mm, preferably between 6 mm and 8 mm.

12 Claims, 4 Drawing Sheets

ROVING MACHINE FOR PRODUCING A ROVING

FIELD OF THE INVENTION

The present invention relates to a roving machine for producing a roving from a sliver, wherein the roving machine comprises at least one spinning station which has a vortex chamber with an infeed opening for the sliver and a roving forming element in the form of a spindle which extends at least partially into the vortex chamber. The vortex chamber is associated with at least one air nozzle through which air can be guided into the vortex chamber, and wherein the spindle has a draw-off channel via which the roving can be drawn out of the vortex chamber.

BACKGROUND

Roving machines for producing roving from (e.g. doubled) slivers, which are in most cases pretreated by means of drafting, have been known in the art for a long time. The roving in turn serves as feed for the subsequent spinning process in which the individual fibers of the roving are spun into a fiber yarn, for example by means of a ring spinning machine. During the production of the roving, it has proved to be useful to draft the fed sliver by means of a drafting frame, which in most cases is part of the roving machine, and subsequently to provide it with a protective twist to give the roving a certain strength. This strength is important so as to prevent that the roving breaks during winding onto a suitable bobbin or during feeding to the downstream spinning machine. However, the applied protective twist must only be strong enough that a cohesion of the individual fibers during the individual winding and unwinding processes and adequate transport processes between the respective machine types is ensured. On the other hand, it must also be ensured that despite the protective twist, the roving can still be processed in a spinning machine. Thus, the roving must still be draftable or separatable into its individual fibers.

To produce a corresponding roving, so-called flyers are primarily used; however, the delivery speed of said flyers is limited due to the occurring centrifugal forces. Thus, many different proposals have already been made to avoid the flyer or to replace it by an alternative machine type (see for example EP 0 375 242 A2 and DE 32 37 989 C2). In this connection, it has been proposed, among other things, to produce the roving by means of air jet spinning machines in which the protective twist is generated by means of air flows. The basic principle here is to guide a sliver through a vortex chamber in which an air vortex is generated. The latter has the effect that a portion of the outer fibers are wound as so-called wrap fibers around the centrally extending fiber strand which, in turn, consists of core fibers which extend substantially parallel to each other.

However, the disadvantage when using corresponding air jet spinning machines is that the latter are not designed for producing roving but rather for spinning fibers into yarns having a strength as high as possible. Thus, the proportion of the wrap fibers is significantly higher. Moreover, due to the geometry of the known air jet spinning stations, the wrap fibers are wound relatively tight around the core fibers and, due to a lack of further draftability, the yarn cannot be used as roving.

SUMMARY OF THE INVENTION

It is therefore an object of the present invention to propose a roving machine by means of which a roving can be produced using an adequate air flow, which roving is suitable for spinning in a subsequent spinning machine. Additional objects and advantages of the invention will be set forth in part in the following description, or may be obvious from the description, or may be learned through practice of the invention.

According to the invention, the roving machine is characterized in that the roving forming element configured as a spindle has a draw-off channel via which the roving can be drawn out of the vortex chamber, wherein in the region of the vortex chamber, the draw-off channel has an inlet port for the roving to be drawn out of the vortex chamber, which inlet port has a diameter, the value of which lies between 4 mm and 12 mm, preferably between 6 mm and 8 mm. When adhering to the mentioned diameter limits, a particularly advantageous air flow develops in the region of the inlet port of the spindle and effects that only a portion of the outer fiber ends are picked up and are wound with the desired strength around the actual fiber core. In contrast, if the diameter is below 4 mm, this comes close to the range which is known from conventional air jet spinning and results in a relatively strong yarn which is suited as roving only to a limited extent. However, if a diameter over 12 mm is selected, the air pressure of the air supplied via the air nozzles has to be increased significantly so as to ensure the needed vortex flow within the vortex chamber because a portion of the inflowing air leaves the vortex chamber through the inlet port of the spindle without contributing to the vortex formation. Thus, it is principally also possible to produce a roving with a spindle, the inlet port of which has a diameter outside of the range according to the invention. However, only by the significant deviation of the diameter from the values known from conventional air jet spinning, which lie between 0.5 and maximum 2.0 mm, a particularly advantageous roving can be produced which is characterized in that a portion of the fibers are wound as wrap fibers around the centrally arranged core fibers (and thus provide the roving with a protective twist), wherein the proportion and the strength of the wrap fibers are just high enough that during the course of the subsequent spinning process, the desired drafting of the roving is still possible.

Also, it is of advantage if the spindle, at least in the region of the inlet port, has an outer diameter, the value of which lies between 5 mm and 14 mm, preferably between 10.0 mm and 11.5 mm. In the region of the inlet port, at least a portion of the fibers which are not completely protected inside the sliver is subjected to the air flow, is partially drawn out of the sliver, and finally wound around the respective core fibers which, from the infeed opening of the vortex chamber, pass the vortex chamber itself and are finally drawn out of the vortex chamber via the inlet port of the spindle. Hereby, the later wrap fibers are bent by the air flow in the region of the spindle tip, which is adjacent to the inlet port of the spindle, and finally wrap around the core fibers. To what extent the fibers are bent here depends in particular on the outer diameter of spindle in the region of the inlet port. A smaller diameter results in more bending and vice versa. If, finally, the outer diameter of the spindle is selected as specified above while adhering to the diameter according to the invention of the spindle inlet port, then the spindle has an outer lateral surface in the region of its inlet port which allows an optimal angular velocity of the air vortexes generated by the air flowing into the vortex chamber. A smaller diameter would result in a higher angular velocity whereby the wrap fibers are extensively twisted resulting in an increased protective twist and a loss of draftability. In contrast, an outer diameter greater than 14 mm would result in an angular velocity which is too low and thus in a poor protective twist.

Furthermore, it is advantageous if at least in the region of the inlet port, the spindle has a wall thickness which has a value between 0.5 mm and 5.0 mm, preferably between 1.0 mm and 2.5 mm, further preferably a value of 1.25 mm. By selecting the mentioned values and by adhering to the inlet port's range according to the invention, an outer diameter of the spindle within the above-mentioned limits can be implemented. Here, the wall thickness can lie over the entire length of the spindle within the mentioned range and can in particular also be constant. It is also conceivable to select the wall thickness such that the values mentioned above apply only to the region of the inlet port while the wall thickness of the remaining spindle differs from the mentioned values.

It is advantageous if at least in the region of the inlet port of the spindle, the vortex chamber has an inner diameter with a value between 10 mm and 16 mm, preferably between 12 mm and 14 mm, further preferably a value of 12.5 mm. In this region, the inlet port of the spindle is surrounded by an adequate wall section, wherein the wall section and the inlet port are preferably arranged concentrically. This results in an annular flow channel between the spindle tip (=region around the inlet port) and the wall of the vortex chamber, in which flow channel, the vortex flow required for forming the protective twist is generated by the inflowing air. At a certain applied pressure which effects that the air flows into the vortex chamber, the rotational speed of the resulting air vortexes within the vortex chamber depends now in particular on the inner diameter of the vortex chamber. If this diameter is too wide, the rotational speed is too low to generate a stable protective twist. If the diameter is too small and thus the rotational speed too high, the protective twist has a strength which counteracts the subsequent drafting, for example within an air jet spinning process. In contrast, when adhering to the aforementioned limits and the diameter range according to the invention of the spindle's inlet port, an optimal air flow is obtained that facilitates the generation of the desired protective twist.

Furthermore, it is advantageous if the distance between the infeed opening of the vortex chamber and the inlet port of the spindle is 2.5 mm to 11.0 mm, preferably 3.5 mm to 6.5 mm. It is to be noted here that the generation of the protective twist should be carried out in the region of the vortex chamber. It should be avoided here that the twist of the sliver propagates against the direction of motion of the sliver into a region outside of the vortex chamber because this could result in that only few fibers project far enough out of the sliver or can be drawn out to be entrained by the air flow and wound as wrap fibers around the core fibers. The desired generation of the protective twist would then not be possible anymore to a sufficient extent. If the distance between the infeed opening of the vortex chamber and the inlet port of the spindle is too large, a torque develops under the action of the air vortexes that is strong enough to cause the undesired propagation of a twist of the sliver. If the mentioned distance is below 2.5 mm, it was found that the engagement surface is too small for the air to be able to generate the desired protective twist.

It is also an advantage if the at least one air nozzle and the inlet port of the spindle are spaced 2 mm to 6 mm, preferably 3 mm to 4 mm, apart from each other in the axial direction of the longitudinal spindle axis. The air nozzles, which in most cases are arranged in multiple sets around the vortex chamber usually extend tangentially into the vortex chamber. The air expands in a laval nozzle-shaped club shape. A part of the club impinges on the spindle tip, is deflected there, and finally entrains fibers so as to wind them in the form of wrap fibers around the core fibers. If the distance between inlet port and the air nozzle(s) is below 2 mm, it is only possible to a limited extent to separate fibers from the current sliver because the possible engagement surface is too small. Thus, there are not enough fiber ends available which can serve as wrap fibers. In contrast, a distance of more than 6 mm causes that separating potential wrap fibers is also made difficult because a significant proportion of the air flowing into the vortex chamber flows through the inlet port into the spindle. This air is ultimately no longer available for the required vortex formation within the vortex chamber so that the production of the desired roving is no longer possible.

Furthermore, it is advantageous if upstream of the vortex chamber, a fiber guiding element is arranged that has a fiber guiding channel that opens out into the infeed opening of the vortex chamber. In this case, the fiber guiding element serves for the controlled guiding of the sliver in the region upstream of the actual vortex chamber of the roving machine. Usually, adequate roving machines have a drafting frame, in particular an apron drafting frame, in which the sliver is drafted and thus equalized prior to entering the vortex chamber. If the sliver would be introduced into the vortex without being guided, this could potentially result in thin or thick places within the sliver. This can ultimately be counteracted by using a fiber guiding element. Further, in the region of the sliver outlet (which transitions into the infeed opening of the vortex chamber), the fiber guiding element can comprise a so-called twist congesting element that can be configured, for example, as an edge, pin, twisted surface, as a cone, or also in the form of a plurality of individual elements arranged offset to each other, and is in contact with the sliver. The twist congesting element prevents here that the sliver twist generated in the vortex chamber propagates in the direction of the fiber guiding element and thereby counteracts the subsequent generation of the protective twist within the vortex chamber, because otherwise it would not be possible anymore to separate fibers from the sliver and to wind them as wrap fibers around the core fibers.

Likewise, it is advantageous if the fiber guiding channel, while maintaining the diameter according to the invention of the spindle's inlet port, has a length, the value of which lies between 4 mm and 12 mm, preferably between 6.0 mm and 9.5 mm. The mentioned length allows a secure guiding of the sliver into the region of the vortex chamber by units adequately arranged upstream, for example an apron drafting frame, without the risk of excessive friction between the sliver and the inner wall of the fiber guiding channel.

Furthermore, it is advantageous if the fiber guiding channel, on its side facing away from the infeed opening of the vortex chamber, has a sliver entry opening, the height of which has a value that lies between 2 mm and 10 mm, preferably between 4 mm and 5 mm. Hereby, the slivers can be guided into the fiber guiding channel without the occurrence of undesired false drafting. In fact, clogging is prevented so that the negative pressure generated by the air flow inside the vortex chamber can propagate counter to the sliver's direction of motion and toward the entry opening of the fiber guiding channel and can facilitate the infeed of the sliver into the vortex chamber.

Likewise, it is advantageous if the fiber guiding channel, on its side facing away from the vortex chamber's infeed opening, has a sliver entry opening, the width of which has a value that lies between 5 mm and 12 mm, preferably between 7 mm and 8 mm. Here, the width lies in the order of the diameter of the inlet port of the spindle. Thus, during its transport through the spinning station, the sliver is not subjected to significant width fluctuations that could negatively influence the quality of the produced roving.

Also, it is extremely advantageous if the ratio between the width of the infeed opening of the vortex chamber and the diameter of the inlet port of the spindle lies between 2.0 and 0.5, preferably between 1.4 and 0.8. This ensures that the fibers can be received by the spindle in a form as straight as possible over the entire width of the sliver, or the roving produced therefrom, and can be drawn out of the vortex chamber in this manner. A roving can also be produced in case of a ratio between the width of the vortex chamber's infeed opening and the diameter of the spindle's inlet port with the ratio deviating from the above-mentioned limits. However, even when maintaining the diameter according to the invention of the spindle's inlet port, the resulting properties of the roving (proportion of wrap fibers, strength, etc.) only come close to the optimum to be achieved if the aforementioned ratio is selected accordingly.

As a result, a roving machine is proposed that allows to produce a roving from a sliver by means of adequate air flows within a vortex chamber. By selecting the individual parameters according to the invention in connection with a spindle inlet port that has a diameter described above, the delivery speed can be considerably increased with respect to conventional roving machines, e.g. in the form of a flyer. In addition, only by maintaining the diameter of the inlet port of the spindle between 4 mm and 12 mm, which diameter thus lies significantly above the maximum diameter of known air jet spinning machines, it is ensured that a roving is obtained that has the required strength and still can be drafted in a subsequent spinning process. A particularly advantageous ratio between strength and draftability is finally achieved if the above-mentioned diameter lies between 6 mm and 8 mm.

BRIEF DESCRIPTION OF THE DRAWINGS

Further advantages of the invention are described in the following exemplary embodiments. In the figures.

DETAILED DESCRIPTION

Figure 1:
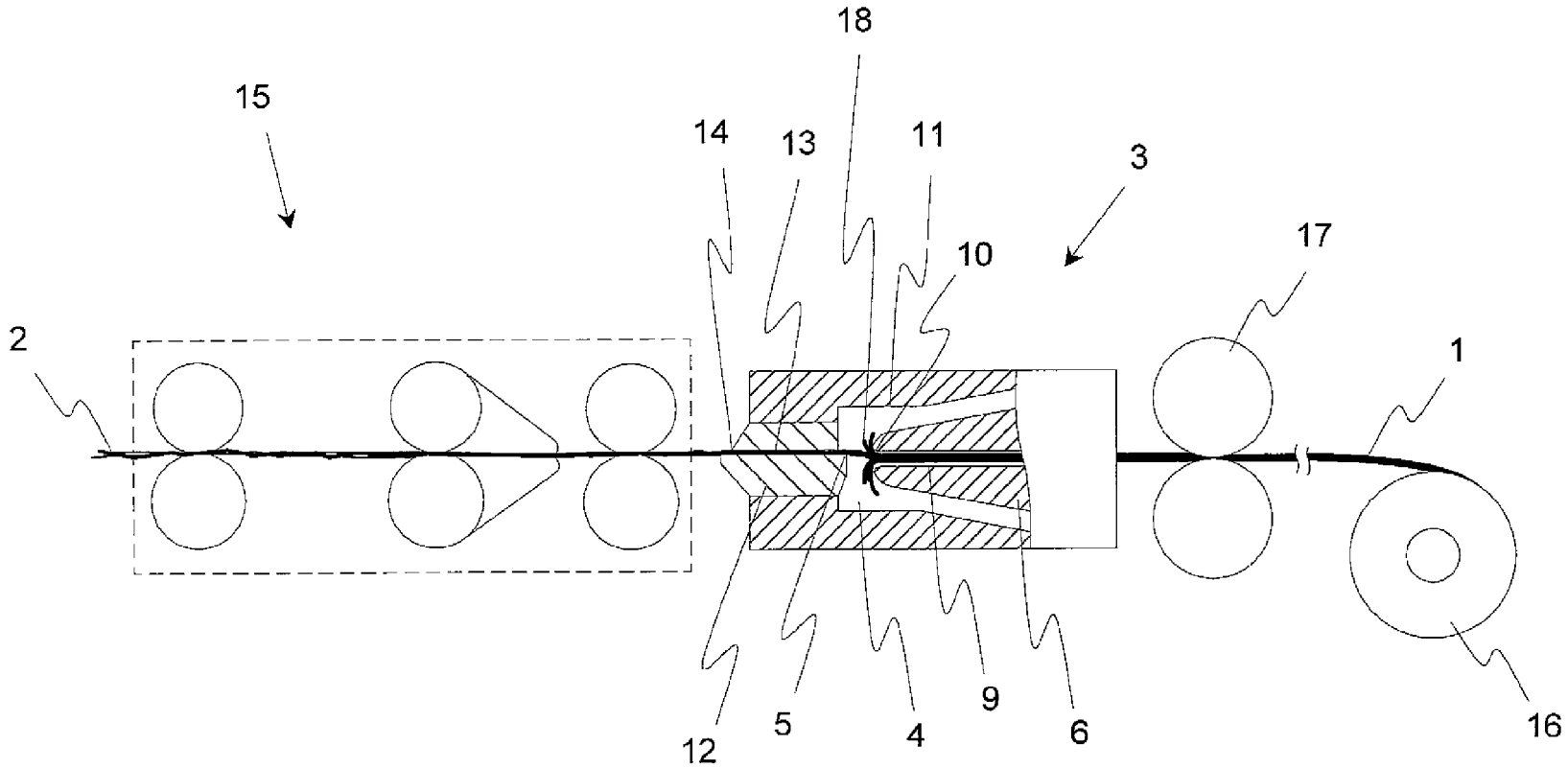
FIG. 1 shows a schematic view of a roving machine according to the invention.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

Figure 3:
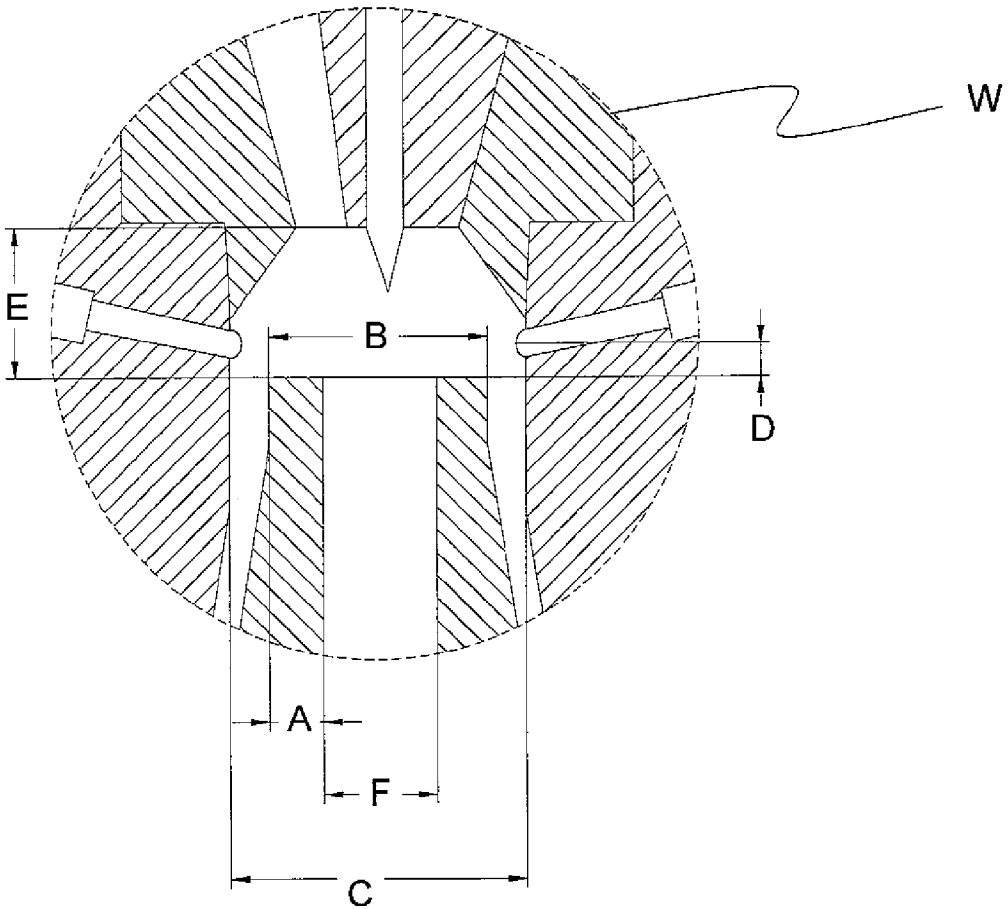
FIG. 3 shows an enlarged illustration of the region "W" in FIG. 2 bordered by a circle drawn with a dashed line.
Figure 4:
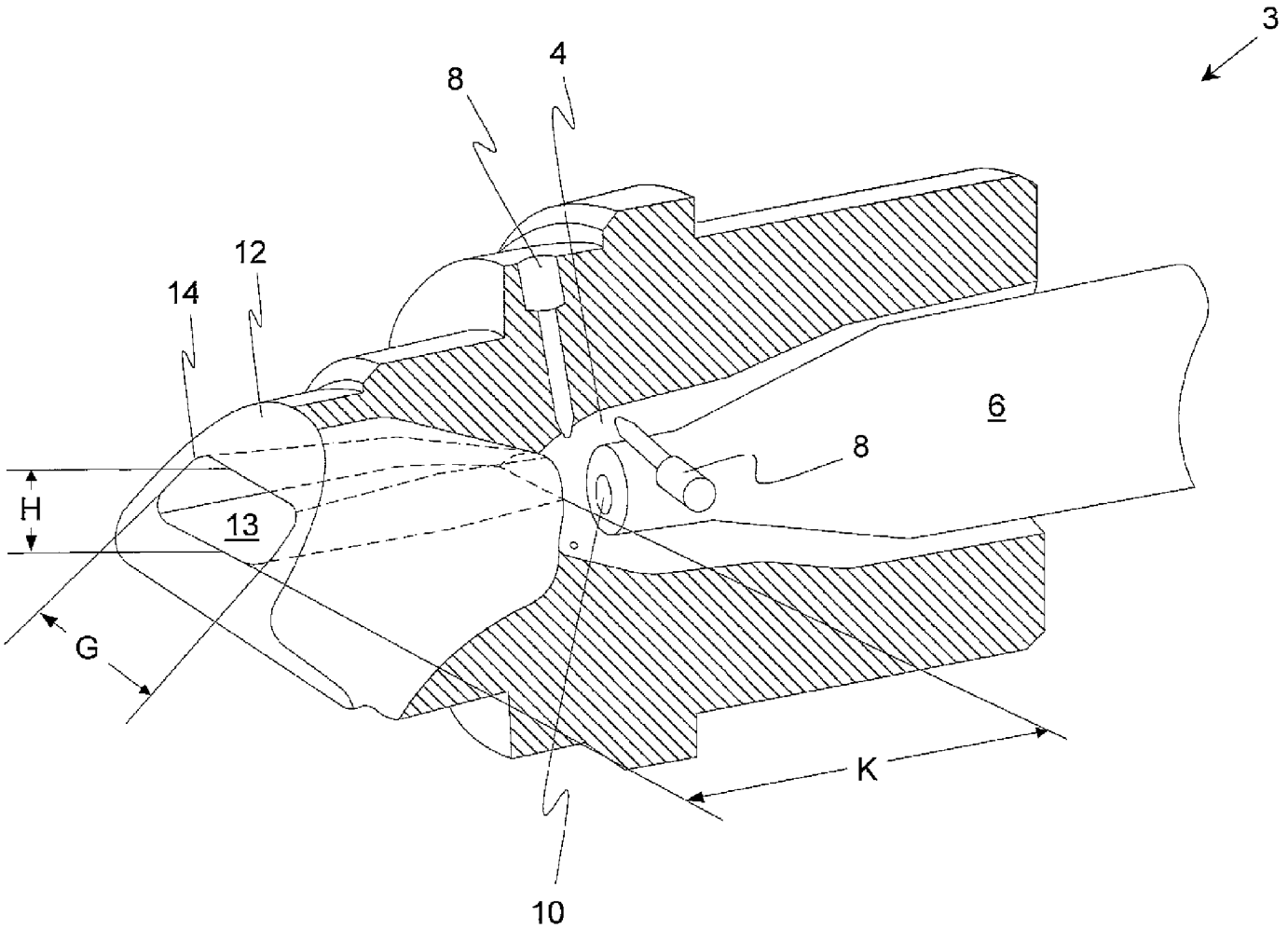
FIG. 4 shows a partial sectional perspective view of a spinning station according to the invention which is not to scale.

At the beginning of the description of the figures, it is explicitly to be noted that the illustrated spinning stations 3, as well as the elements potentially arranged upstream or downstream thereof, are not drawn to scale. Rather, the individual figures merely show schematic drawings which are intended to clarify the principal structure of the respective assemblies. In particular, the distances and diameters marked in each case in the FIGS. 3 and 4 show values in the drawings that do not necessarily or directly represent the exact ranges according to the invention.

FIG. 1 shows a schematic view of a detail of a roving machine according to the invention. If required, the roving machine can comprise a drafting frame 15 that is supplied with a sliver 2, for example in the form of a doubled sliver. Further, the shown roving machine principally comprises a spinning station 3 that is spaced apart from the drafting frame 15 and has an internal vortex chamber 4 in which the sliver 2, or at least a portion of the fibers of the sliver 2, is provided with a protective twist (the exact principle of operation of the spinning station 3 is explained in more detail hereinafter).

Further, the roving machine can comprise a pair of draw-off rollers 17, as well as a winding device 16 (schematically illustrated) for the roving 1, which winding device is arranged downstream of the pair of draw-off rollers 17. The device according to the invention does not necessarily have to have a drafting frame 15, as it is illustrated in FIG. 1. Also, the pair the draw-off rollers 17 is not necessarily required.

The spinning device operates according to a special air jet spinning method that originally has been used to produce finished yarn. As already mentioned, devices for generating yarn are in principle not suited for the production of a draftable roving 1. Although there are already indications known from the prior art on how to produce also roving 1 by means of an air jet spinning system, up to now, there is still a lack of concrete dimensional data with respect to relevant diameters or distances of individual components of the actual spinning station 3. However, it has been found that the selection of the correct values is crucial for the properties of the later roving 1.

In fact, it is essential for the production of roving 1 that the sliver 2 introduced via an infeed opening 5 into the vortex chamber 4 receives only one protective twist so that the roving 1 produced in this manner remains draftable for the further processing in a subsequent spinning machine, for example a ring spinning machine. In contrast, conventional air jet spinning devices give the sliver 2 such a strong twist that the draft required subsequent to the yarn production is not possible anymore. In this case, this is actually desired because conventional air jet spinning machines are designed for producing yarn, which usually is to be characterized by high strength.

The inventors have recognized that by suitable modifications of the respective components of an air jet spinning device, it is also possible to produce draftable rovings 1, wherein the respective values are addressed in more detail with reference to the FIGS. 3 and 4.

In order to form the roving 1, the sliver 2 is now guided through a fiber guiding channel 13 having an adequate entry opening 14 of a fiber guiding element 12 into the vortex chamber 4 of the spinning station 3. There, the sliver receives a protective twist, i.e. at least a portion of the fibers of the sliver 2 is entrained by an air flow which is generated by air nozzles 8 which are adequately arranged in a wall defining the vortex chamber 4. A portion of the fibers is drawn out of the sliver 2, at least to a certain extent, and is wound around the tip of a spindle 6 protruding into the vortex chamber 4. Due to the fact that the sliver 2 is drawn out of the vortex chamber 4 through an inlet port 10 of the spindle 6 and via a draw-off channel 9 arranged within the spindle 6, the free fiber ends 18 (see FIG. 1) are finally also drawn in the direction of the inlet port 10 and wind themselves as wrap fibers around the centrally extending core fibers, resulting in the roving 1 having the desired protective twist. With respect to the air nozzles 8, it should be mentioned here as a precaution that these nozzles should usually be aligned in such a manner that the outflowing air jets are equidirectional so as to jointly generate an equidirectional air flow having a rotational direction. Preferably, the individual nozzles are arranged rotationally symmetrically with respect to each other.

Figure 2:
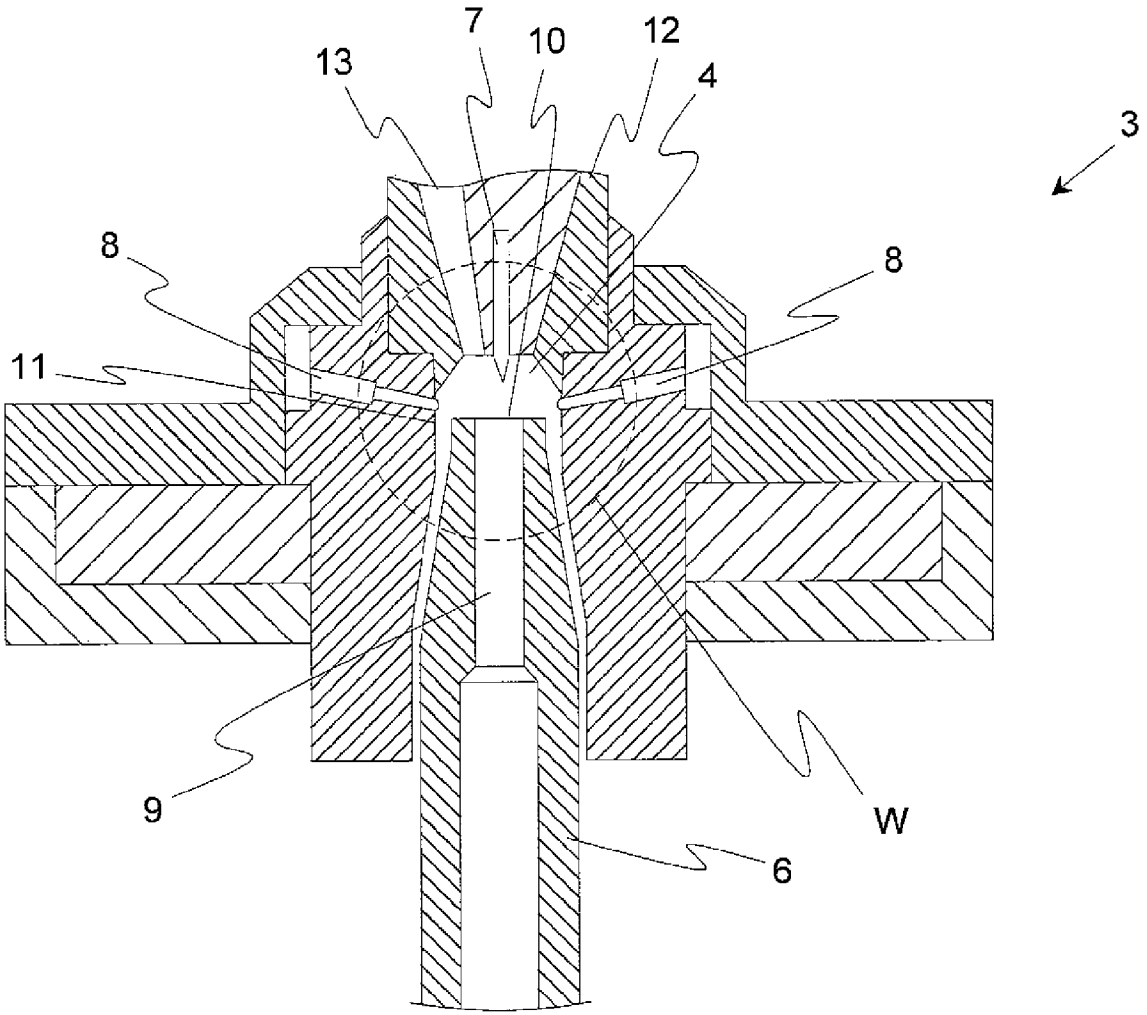
FIG. 2 shows a sectional view of a spinning station according to the invention which is not to scale.

Preferably, the spinning station 3 according to the invention has a twist congesting element 7 that is inserted for example in the fiber guiding element 12 and, which in the case of the FIGS. 2 and 3, is formed as a pin. The latter serves substantially as "false yarn core" and ensures that a twist in the sliver 2 propagates counter to the delivery direction of the sliver 2 and thus in the direction of the entry opening 14 of the fiber guiding element 12.

The dimensions claimed in the claims are marked in the FIGS. 3 and 4. For reasons of clarity, the remaining reference numbers were omitted in FIG. 3. However, they can be found in FIG. 2 that, apart from further details, shows the region "W" shown in FIG. 3 in an identical manner. As a result, the region "W" in FIG. 2 thus corresponds to the illustration as shown in FIG. 3.

It is provided according to the invention that the diameter F of the inlet port 10 of spindle 6 has a value between 4 mm and 12 mm, preferably between 6 mm and 8 mm. Due to the significant deviation from the corresponding inner diameter of a spindle 6 as it is used in case of conventional air jet spinning devices, the desired roving 1 is finally obtained. The latter is characterized by the above-mentioned protective twist that provides the roving 1 with the required strength and also with the necessary draftability so as to be able to spin it in a subsequent spinning machine. If, however, the mentioned diameter is outside of the above limits, the strength is increased too much.

Furthermore, the mentioned properties can be further improved if the following distances or diameters (see FIGS. 3 and 4) are in each case within the listed limits. It should be noted in this connection that in some cases, several ranges for the individual distances or diameters are specified (see wall thickness A). In such cases, the outer values define limits within which the respective variables should lie so as to obtain a usable roving 1. The inner values specify limits that define a particularly advantageous range of the respective variable—resulting in roving properties that are improved again. Finally, in some cases, concrete single values are specified that have proved to be particularly advantageous. The respective ranges or single values are the following ones:

A Wall thickness in the region of the inlet port 10 of the spindle 6: 0.5 mm to 5.0 mm, preferably 1.0 mm to 2.5 mm, further preferably: 1.25 mm.

B Outer diameter of the spindle 6 in the region of its inlet port 10: 5 mm to 14 mm, preferably 10.0 mm to 11.5 mm.

C Inner diameter of the vortex chamber 4 in the region of the inlet port 10 of the spindle 6 (see wall section 11): 10 mm to 16 mm, preferably 12 mm to 14 mm, further preferably: 12.5 mm.

D Distance between air nozzle 8 and inlet port 10 of the spindle 6 (measured in the direction of the longitudinal spindle axis): 2 mm to 6 mm, preferably 3 mm to 4 mm.

E Distance between the infeed opening 5 of the vortex chamber 4 and the inlet port 10 of the spindle 6: 2.5 mm to 11.0 mm, preferably 3.5 mm to 6.5 mm.

F Diameter of the inlet port 10 of the spindle 6: 4 mm to 12 mm, preferably 6 mm to 8 mm.

G Width of the entry opening 14 of the fiber guiding channel 13: 5 mm to 12 mm, preferably 7 mm to 8 mm.

H Height of the entry opening 14 of the fiber guiding channel 13: 2 mm to 10 mm, preferably 4 mm to 5 mm.

K Length of the fiber guiding channel 13: 4 mm to 12 mm, preferably 6.0 mm to 9.5 mm.

With respect to the advantages of the respective values, reference is made to the general portion of the description so as to avoid repetitions.

As a result, a roving machine is proposed by means of which a roving 1 can be produced that has substantially the same properties as a roving 1 produced with a conventional flyer.

Furthermore, the invention is not limited to the illustrated exemplary embodiments. In fact, all combinations of the described individual features as shown or described in the claims, the description and the figures, and insofar a corresponding combination appears to be technically feasible and reasonable, are subject matter of the invention.

The invention claimed is:

1. A roving machine for producing a roving from a sliver, comprising:

a spinning station having a vortex chamber with an infeed opening for the sliver;

a roving forming element in the form of a stationary spindle downstream of said vortex chamber and having a tip extending at least partially into said vortex chamber;

said spindle comprising a draw-off channel in said tip via which the roving is drawn of said vortex chamber;

at least one air nozzle upstream of said tip and configured to direct air into said vortex chamber; and said draw-off channel having an inlet port in the region of said vortex chamber with a diameter between 4 mm and 12 mm.

2. The roving machine as in claim 1, wherein said spindle tip has an outer diameter in the region of said vortex chamber between 5 mm and 14 mm.

3. The roving machine as in claim 1, wherein said spindle tip has a wall thickness in the region of said inlet port between 0.5 mm and 5 mm.

4. The roving machine as in claim 3, wherein said wall thickness is between 1.0 mm and 2.5 mm.

5. The roving machine as in claim 1, wherein said vortex chamber has an inner diameter in the region of said inlet port between 10 mm and 16 mm.

6. The roving machine as in claim 1, wherein a distance between said infeed opening and said inlet port is between 2.5 mm and 11.0 mm.

7. The roving machine as in claim 1, wherein an axial longitudinal distance between said air nozzle and said inlet port is between 2 mm and 6 mm.

8. The roving machine as in claim 1, comprising a fiber guiding element upstream of said vortex chamber, said fiber guiding element having a fiber guiding channel that opens out into said infeed opening of said vortex chamber.

9. The roving machine as in claim 8, wherein said fiber guiding channel has a length between 4 mm and 12 mm.

10. The roving machine as in claim 9, wherein said fiber guiding channel has an entry opening on a side facing away from said infeed opening with a height between 2 mm and 10 mm.

11. The roving machine as in claim 10, wherein said entry opening has a width between 5 mm and 12 mm.

12. The roving machine as in claim 1, wherein a ratio between a width of said infeed opening and said inlet port is between 2.0 and 0.5.

* * * * *